US006974366B1

(12) United States Patent
Johnson

(10) Patent No.: US 6,974,366 B1
(45) Date of Patent: Dec. 13, 2005

(54) GARMENT IMAGE ABRASION SYSTEM AND METHOD

(76) Inventor: Larry Johnson, 7254 Tanager Dr., Rapid City, SD (US) 57702

( * ) Notice: Subject to any disclaimer, the term of this patent is extended or adjusted under 35 U.S.C. 154(b) by 363 days.

(21) Appl. No.: 10/320,558

(22) Filed: Dec. 13, 2002

(51) Int. Cl.[7] ..... B24B 1/00; B24B 7/00
(52) U.S. Cl. ..... 451/29; 451/38; 451/445
(58) Field of Search ..... 26/69 R, 69 C; 451/29, 31, 445, 38

(56) References Cited

U.S. PATENT DOCUMENTS

| | | | | |
|---|---|---|---|---|
| 509,296 A | | 11/1893 | Brown | |
| 1,431,917 A | * | 10/1922 | Antaramian | 29/76.1 |
| RE19,238 E | * | 7/1934 | Burke | 434/96 |
| 2,504,183 A | | 4/1950 | Croft | |
| 4,336,753 A | | 6/1982 | Vidalis | |
| 4,427,390 A | * | 1/1984 | Manger | 434/159 |
| 4,951,366 A | | 8/1990 | Geller | |
| 5,218,747 A | | 6/1993 | Riedel | |
| 5,505,739 A | * | 4/1996 | Montesano | 8/102 |
| 5,567,207 A | | 10/1996 | Lockman et al. | |
| 6,002,099 A | | 12/1999 | Martin et al. | |
| 6,122,807 A | * | 9/2000 | Beltramini | 26/28 |
| 6,152,811 A | | 11/2000 | Crosta | |
| 6,252,196 B1 | | 6/2001 | Costin et al. | |

* cited by examiner

*Primary Examiner*—Timothy V. Eley

(57) ABSTRACT

A garment image abrasion system and method for abrading an image into a garment is disclosed. The garment image abrasion system includes a template member having a template surface in the shape of an image desired to be abraded into a garment. In the disclosed method, the template member is placed under the fabric of the garment and an abrading tool is used to apply pressure between the abrading tool and the template surface to abrade the fabric.

21 Claims, 6 Drawing Sheets

GARMENT IMAGE ABRASION SYSTEM AND METHOD

BACKGROUND OF THE INVENTION

1. Field of the Invention

The present invention relates to garments and more particularly pertains to a new garment image abrasion system and method for abrading an image into a garment.

2. Description of the Prior Art

The demarcation or abrasion of garments and materials is known in the prior art. U.S. Pat. No. 4,951,366 issued to Geller describes a method for projecting a stream of particles at a fabric surface to obtain softening, worn or laundered appearance, design pattern, picture, printing, textured or sculptured effects. U.S. Pat. No. 5,218,747 issued to Riedel discloses a method of and arrangement for grinding web-shaped textile structures. U.S. Pat. No. 6,002,099 issued to Martin et al. discloses a computer-controlled system for laser simulation of the particle distribution in a sandblasting process to generate a feathered worn look. U.S. Pat. No. 5,567,207 issued to Lockman et al. discloses another method for marking and fading textiles using lasers. U.S. Pat. No. 6,152,811 issued to Crosta discloses a fabric raising machine. U.S. Pat. No. 2,504,183 issued to Croft relates to the dyeing of textiles and more particularly discloses a process for the production of dyed fibers. U.S. Pat. No. 509,296 issued to Brown discloses a cloth finishing machine that uses bristles applied to cloth in a beating motion to provide a worsted effect. U.S. Pat. No. 6,252,196 issued to Costin et al. discloses a laser method for scribing graphics on materials. U.S. Pat. No. 4,336,753 issued to Vidalis discloses a dye printing system for producing a multi-colored pattern on rugs.

While these devices fulfill their respective, particular objectives and requirements, the need remains for a system that can be used to create customized images on fabrics of existing garments in a quick and economical manner.

SUMMARY OF THE INVENTION

The present invention meets the needs presented above by providing the necessary equipment and process to abrade images into a fabric, particularly denim, within minutes using selectable image templates.

An object of the present invention is to provide a new garment image abrasion system and method that is suitable for use in public shopping stores and malls to provide walk up service.

Another object of the present invention is to provide a new garment image abrasion system and method that has a low overhead cost.

Still another object of the present invention is to provide a method of abrading an image into a garment that can be used by persons of little artistic ability by using templates and application of a planar abrading surface while permitting those with greater artistic ability the opportunity to create more complex images through alterations in pressure and duration of abrasion utilizing a rotary tool for abrading.

To this end, the present invention generally comprises a template member having a template surface in the shape of an image desired to be abraded into a garment. The template is placed under the fabric of the garment and an abrading tool is used to apply pressure between the abrading tool and the template surface to abrade the fabric.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
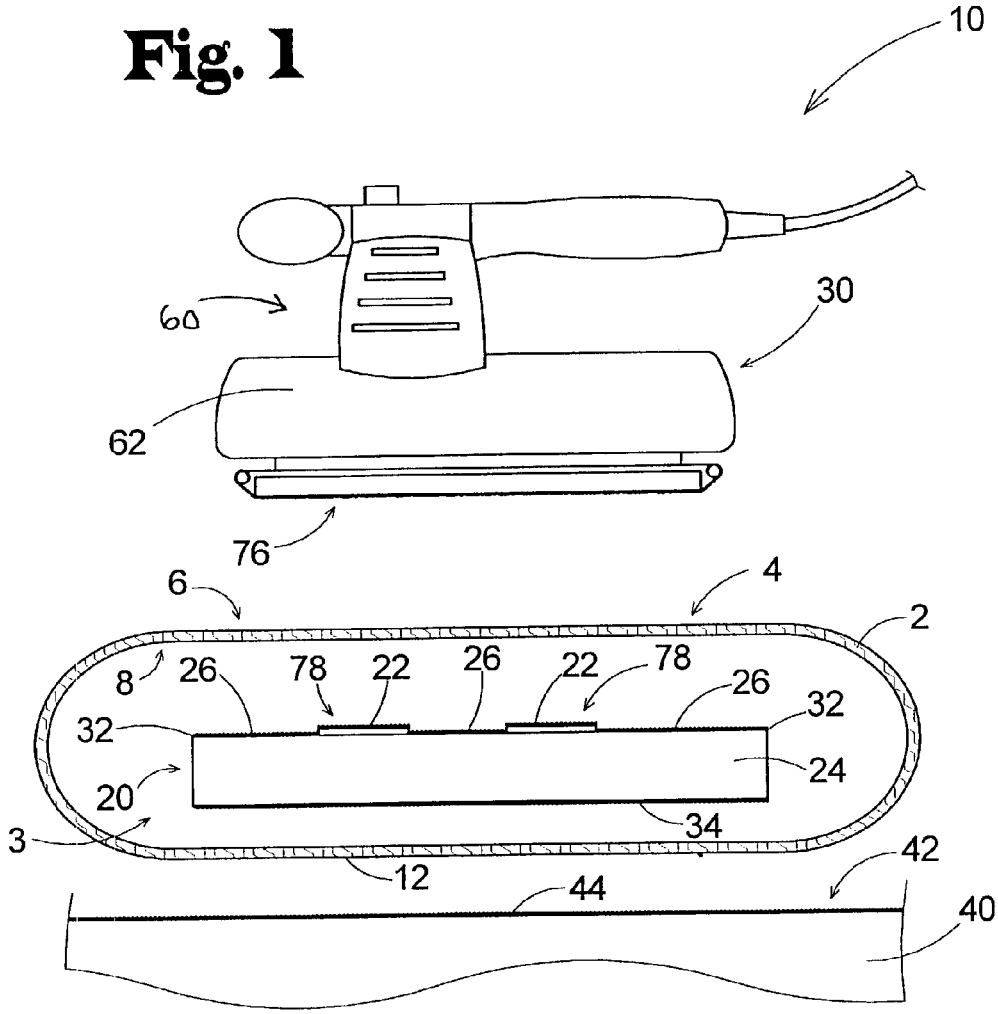
FIG. 1 is an exploded side view of a new garment image abrasion system according to the present invention.
Figure 2:
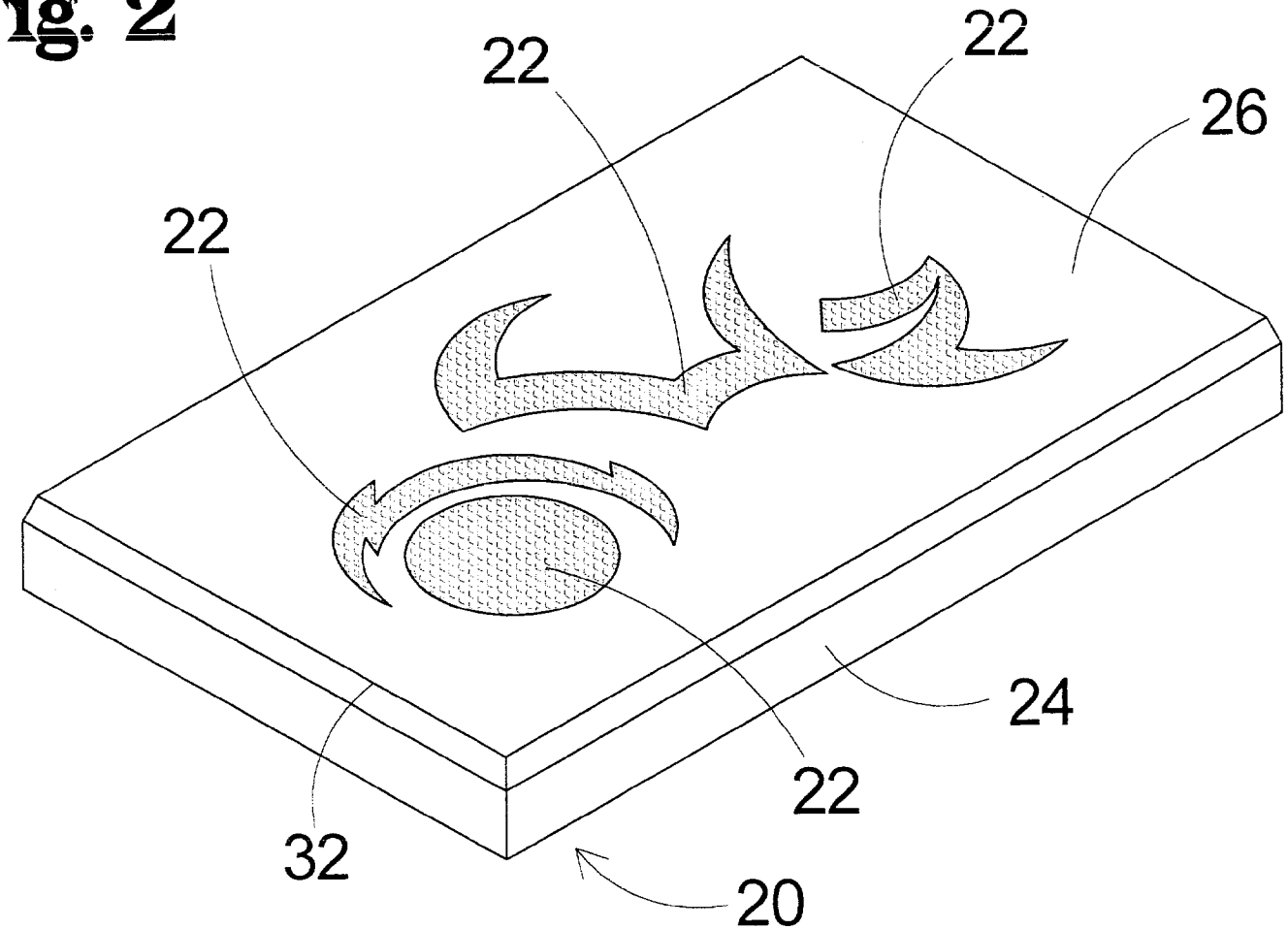
FIG. 2 is a perspective view of a template member of the present invention.
Figure 3:
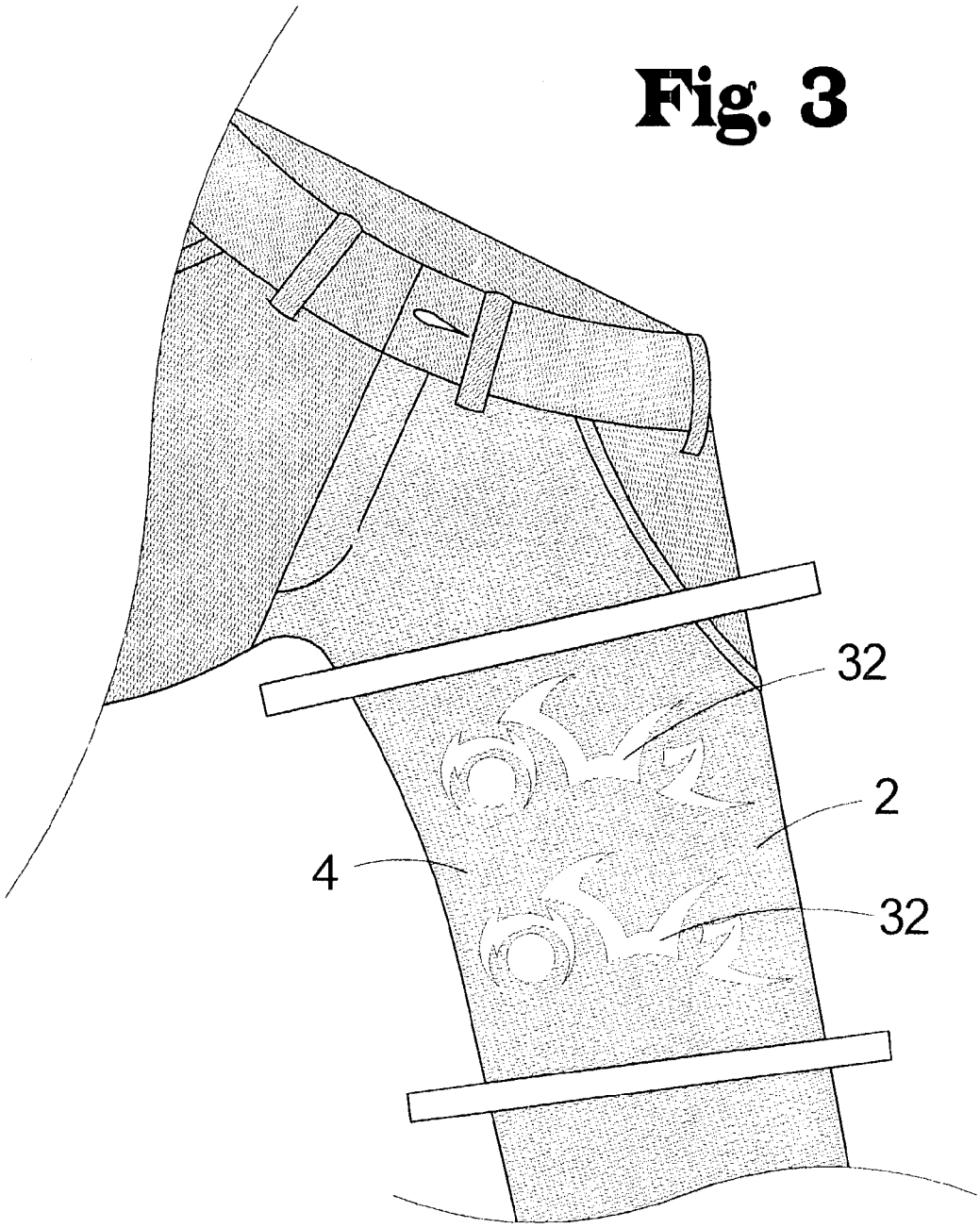
FIG. 3 is a top view of an abraded image produced by the present invention.
Figure 4:
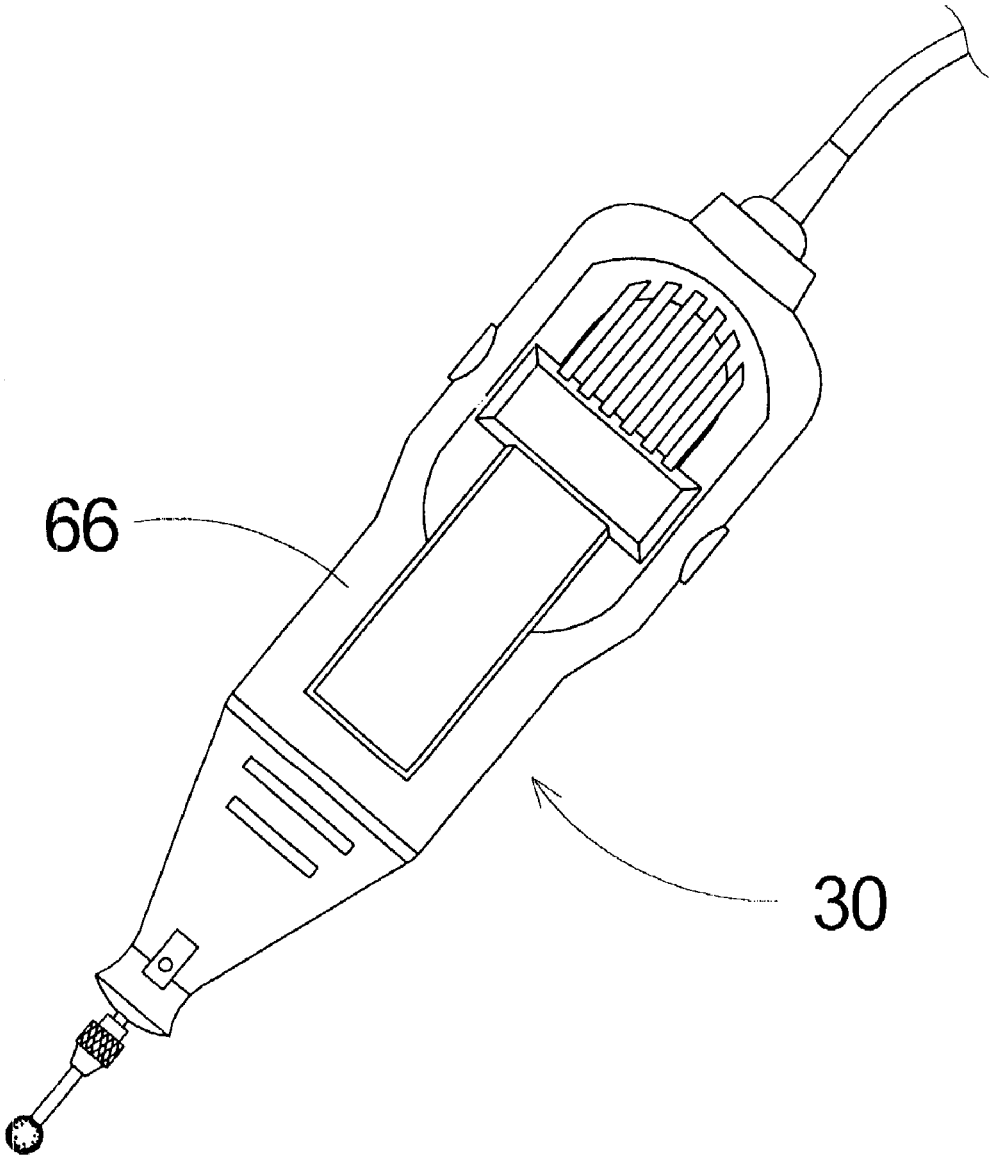
FIG. 4 is a side view of an alternate abrading device of the present invention.
Figure 5:
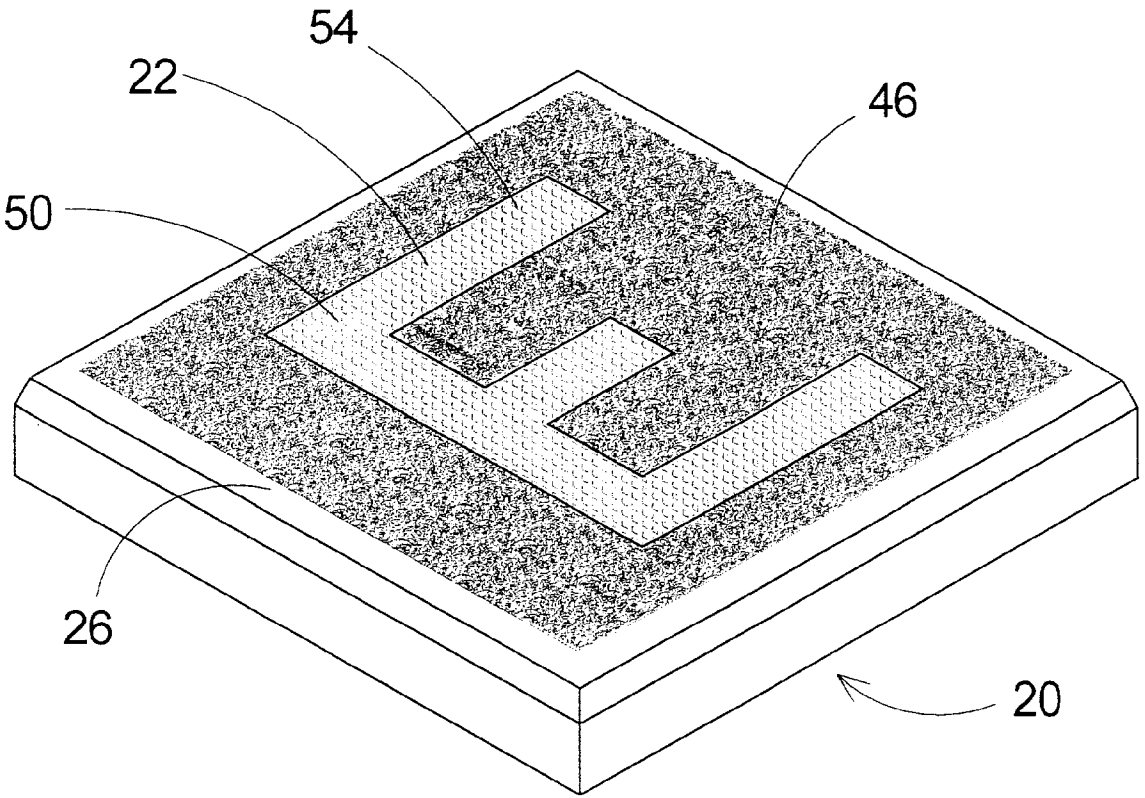
FIG. 5 is a perspective view of an alternate template member of the present invention.
Figure 6:
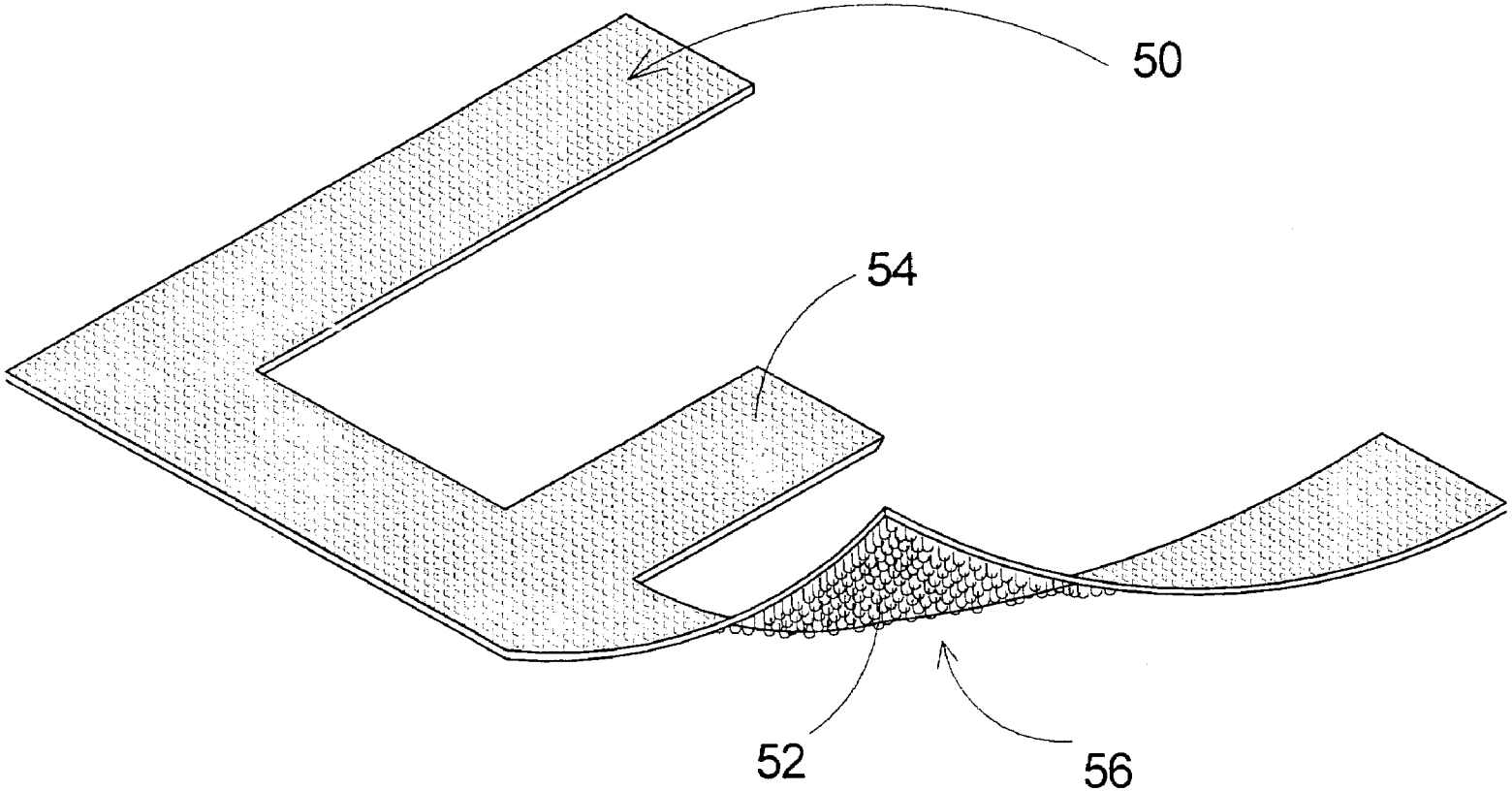
FIG. 6 is a perspective view of a removable template pattern member of the present invention.

With reference now to the drawings, and in particular to FIGS. 1 through 6 thereof, a new garment image abrasion system and method embodying the principles and concepts of the present invention and generally designated by the reference numeral 10 will be described.

As best illustrated in FIGS. 1 through 6, the garment image abrasion system 10 generally comprises a template member 20 having a template surface 22 positionable against a garment 2. An abrading device 30 is used for abrading a surface 4 of the garment 2 on an opposite side of the garment from the template surface 22. The abrasion occurs in those areas of the surface 4 positioned between the abrading device 30 and the template surface 22. Thus, the abrasion creates an image 32 on the surface 4 of the garment 2 that will correspond to the shape of the template surface 22 by abrading the surface 4 of the garment over an entirety of the template surface 22. The garment 2 is typically constructed of denim as this fabric produces excellent results. Further, denim is comfortable yet strong to permit sufficient abrasion without destroying the integrity of the fabric. Some weakening of the fabric will occur due to the abrading but, as shown in the described purposes of the prior art cited above, wearing or tattering of garments can be a desired effect so the present invention may be used to intentionally produce threadbare images or tattering in desired shapes.

The surface 4 is a first surface 6 of the garment 2. The template surface 22 frictionally engages a second surface 8 of the garment 2 opposite the first surface 6 for restricting movement of the second surface 8 relative to the template surface 22 during abrasion of the first surface 6. Best results are achieved by holding the garment in a stabilized position, particularly the area positioned directly against the template surface 22. In this manner, the abrasion is limited to the area of the template surface 22.

The template surface 22 is raised from a main portion 24 of the template member 20 such that the template surface 22 is positioned in a spaced relationship above an upper surface 26 of the main portion 24 of the template member 20. For denim, a minimum distance between a plane in which the template surface 22 lies and a second plane in which the upper surface 26 lies is one sixty-fourth of an inch. Greater distances may be used to promote better definition of the edges of the image when abrading however, too great a distance permits some movement of the garment immediately adjacent to the portion being abraded resulting in less defined image edges. A distance of one thirty-second of an inch produces good results.

Through experimentation with the disclosed method, it has been found valuable that a perimeter edge 32 of the upper surface 26 be beveled or rounded to fall away from the perimeter edge 32 to prevent abrasion of the garment 2 adjacent to the perimeter edge 32.

It is important that the template member 20 remain stationary during abrasion. However, some garments or portions of garments on which a person may wish to put an image are not easily positioned against a template surface that is fixed to a base such as a work table. This is particularly true for leg or arm portions of garments where the fabric forms a generally cylindrical or tubular shape. To permit insertion of the template member into the garment into a stabilized position, the template member 20 may include a frictional base surface 34 opposite the template surface 26 for preventing movement of the base surface 34 during abrading of the surface 4 of the garment 2. In such a case, the garment 2 has an interior 3. The template member 20 is inserted into the interior 3 of the garment 2 such that the template member 20 is positioned between two portions of the garment 2. For example, to place an image on the front knee area of a pair of jeans, the template member is positioned in the leg of the jeans. The base surface engages the interior surface of the back of the leg of the jeans while the front of the leg of the jeans is positioned against the template surface. Applying pressure to the front of the leg of the jeans then abrades the front of the jeans and promotes frictional engagement between the base surface on the back of the jeans.

Best results are achieved by creating sufficient friction between the surface 4 and the abrading tool 30 to abrade the surface 4 while maintaining greater friction between the garment 2 and the template surface 22 to hold the garment in place. The more that movement can be restricted between the garment and the template surface, the better defined the abraded image will be. Further steps can be taken to assist in holding the garment in place including placement of the garment on a frictional surface. A work table 40 may be provided having a work surface 42 covered by a frictional material 44 for engaging the outer surface 12 of the garment 2 for preventing movement between the work table 40 and the outer surface 12 during abrasion of the surface 4 of the garment 2. It is also beneficial to strap down or secure portions of the garment remote to the area being abraded.

Various designs may be formed by the template surface 22. To provide immediately customizable images such as a string of written characters such as letters or numbers, the upper surface 26 of the main portion 24 is substantially planar and a portion of hook and loop fastener 46 is coupled to the upper surface 26. A planar template pattern member 50 is provided having a connection side 52 and a template side 54. A complimentary portion of hook and loop fastener 56 is coupled to the connection side 52 whereby the template pattern member 50 is removably couplable to the upper surface 26 of the main portion 24 of the template member 20. The template side 54 of the template pattern member 50 then defines the template surface 22 and would be frictional sufficient to hold the surface 4 in place during abrasion. The template pattern member 50 is one of a plurality of template pattern members. Each template pattern member 50 is selectively couplable to the template member 20 and one or several can be attached as desired.

To facilitate abrasion of the surface 4, a power tool 60 may be used. The abrasion of denim or other fabric, typically lightens or fades the coloration of the fabric. The use of a sander 62 is desirable to apply even pressure over a larger template surface area for a uniform duration of time. To achieve a uniform fading or lightening, it is important that the abrading surface and the template surface be planar and even to maintain uniform pressure over the area being abraded. Variations in degree of abrasion will create different shades of coloration of the fabric. Thus, alteration of the duration of abrasion or pressure applied during abrasion allows a person control of shading of the image being abraded. For producing fine lines in images or to permit greater flexibility in shading of the image through variations in duration and/or pressure, a rotary tool 66, such as the type sold under the trademark name DREMEL, may be used.

Shading may also be achieved by having a template surface that is intentionally uneven or multi-leveled. Thus, variations of pressure will be created when the garment is positioned under pressure between the abrading surface and the template surface. When abrading is applied for a uniform period of time, the pressure differences will provide variations in the lightening or fading of coloration to provide desired shading.

To provide a well defined border for the image, it is desirable to hold the areas of the garment immediately adjacent to the surface being abraded to prevent movement of the garment. The upper surface 26 of the main portion may be frictional to facilitate static positioning of areas of the garment adjacent to the surface abraded by the abrading device.

Tracing around the shape of the template surface 22 prior to abrading the surface 4 of the garment 2 facilitates creation of distinct abrading edges. This is particularly important to achieve good definition between closely positioned edges of the template surface. Effective tracing may be achieved by hand or through use of a tool to push on the garment around the edges of the template surface.

To enhance the effects of tracing around the template surface or to enhance the frictional engagement between the template surface and the garment, light wetting of the area of the garment to be positioned against the template surface is desirable prior to positioning the template surface against the garment. Wetting enhances the ability of the garment to remain in place by reducing the resilience of the fabric to return to an original position thus enhancing the effect of tracing around the template surface. Experimentation has shown that it is preferred to have only light wetting to prevent wicking to the surface 4 when the fabric is placed under pressure during abrasion. Experimentation has shown that wetting of the surface 4 promotes generally undesired movement between the fabric and the template surface during abrasion. A hair dryer or similar device may be used to blow hot air onto the surface 4 to provide drying of the surface 4 as desired.

In use, a portion of the garment 2 is positioned under pressure between two oppositional surfaces 76 and 78. Each of the surfaces 76 and 78 has an associated coefficient of friction relative to the garment 2. As shown, the surface 76 is designed to have a lower coefficient of friction relative to the garment than surface 78. The garment 2 is abraded to produce the results described above by moving the surface 76 against the garment 2. The differential in the respective coefficients of friction between surfaces 76 and 78 result in the garment being held in place by surface 78 while surface 76 abrades the garment 2. The surface 78 forms the template and abrasion over the entirety of the surface 78 will result in an image corresponding to the shape of surface 78.

Experimentation has shown that sandpaper having a grit of 50 or higher is good for use to form the template surface when abrading a denim garment. When using 60 grit sandpaper for the template surface and any other previously described surfaces that are designed to hold the garment in place, sandpaper having a grit equal or greater to the template surface grit is good for abrading the image into the garment.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of abrading an image into a garment, the steps of the method comprising:

providing a garment;

providing a template member, said template member having a template surface, said template surface is positioned in spaced relationship above an upper surface of a main portion of said template member, and is removably couplable to said main portion;

positioning said template surface against said garment; and abrading a surface of said garment opposite said template surface whereby an image is made visible on said surface of said garment.

2. The method of claim 1, the steps of the method further comprising:

abrading said surface of said garment over an entirety of said template surface whereby said image corresponds to a shape of said template surface.

3. The method of claim 1, the steps of the method further comprising:

providing a power tool for abrading said surface of said garment.

4. The method of claim 3 wherein said power tool is one power tool chosen from the group of power tools consisting of a sander and a rotary tool.

5. The method of claim 3, wherein a coefficient of friction between the garment and the template surface is greater than a coefficient of friction between the garment and abrading surface of said power tool.

6. The method of claim 1 wherein said template surface is positioned in a single plane.

7. The method of claim 1 wherein said main portion includes a beveled edge surrounding said upper surface of said main portion.

8. The method of claim 1, the steps of the method further comprising:

wetting an area of said garment to be positioned against said template member prior to positioning said template member against said garment.

9. The method of claim 1, the steps of the method further comprising:

tracing on said garment around said shape of said template surface prior to abrading said surface of said garment to facilitate creating distinct abrading edges on said surface of said garment when abrading said surface of said garment.

10. A garment image abrasion system comprising:

a garment;

a template member having a template surface positionable against said garment, said template surface is positioned in spaced relationship above an upper surface of a main portion of said template member, and is removably couplable to said main portion;

an abrading device for abrading a surface of said garment on an opposite side of said garment from said template surface for creating an image on said surface of said garment on said opposite side of said garment from said template surface.

11. The garment image abrasion system of claim 10 wherein said surface abraded by said abrading device is a first surface; and wherein said template surface frictionally engages a second surface of said garment opposite said first surface for restricting movement of said second surface of said garment relative to said template surface during abrasion of said first surface.

12. The garment image abrasion system of claim 10 wherein a perimeter edge of said upper surface of said main portion is beveled to prevent abrasion of said garment adjacent to said perimeter edge.

13. The garment image abrasion system of claim 10 wherein a perimeter edge of said upper surface of said main portion is rounded to prevent abrasion of said garment adjacent to said perimeter edge.

14. The garment image abrasion system of claim 10, further comprising:

said template member having a frictional base surface opposite said template surface for preventing movement of said base surface during abrading of said surface of said garment.

15. The garment image abrasion system of claim 10, further comprising:

said garment having an interior;

said template member being insertable into said interior of said garment such that said template member is positioned between two portions of said garment;

a work table having a work surface, said work surface being covered by a frictional material for engaging an outer surface of one of said two portions of said garment for preventing movement between said work table and said outer surface of said one of said two portions of said garment during abrasion of said surface of said garment.

16. The garment image abrasion system of claim 15, further comprising:

said template member having a frictional base surface opposite said template surface for engaging an interior surface of said one of said two portions of said garment for preventing movement between said interior surface of said one of said two portions of said garment and said base surface of said template member during abrading of said surface of said garment.

17. The garment image abrasion system of claim 10, further comprising:

said template member having a main portion, an upper surface of said main portion being substantially planar;

a portion of hook and loop fastener coupled to said upper surface of said main portion;

a planar template pattern member having a connection side and a template side;

a complimentary portion of hook and loop fastener coupled to said first side of said template pattern whereby said template pattern is removably couplable to said upper surface of said main portion of said template member such that said template side of said template pattern defines said template surface.

18. The garment image abrasion system of claim 17, further comprising:

said template pattern being one of a plurality of template patterns each being selectively couplable to said template member.

19. The garment image abrasion system of claim 18 wherein each of said template patterns is shaped to form a written character.

20. The garment image abrasion system of claim 10, further comprising:

said template member having a main portion, an upper surface of said main portion being substantially planar and positioned in spaced relationship to said template surface;

said upper surface of said main portion being frictional to facilitate static positioning of areas of said garment adjacent to said surface abraded by said abrading device.

21. The garment image abrasion system of claim 10 wherein a minimum distance between a plane in which said template surface lies and a second plane in which said upper surface of said main portion of said template member lies is one sixty-fourth of an inch.

* * * * *